US006302380B1

(12) United States Patent
Ultimo, Sr. et al.

(10) Patent No.: US 6,302,380 B1
(45) Date of Patent: Oct. 16, 2001

(54) PORTABLE INJECTION-CASING EXTRACTOR

(75) Inventors: Frank D. Ultimo, Sr., Dana Point; Luis Enrique Hernandez, Upland; Naepu Joseph Pak, Tustin, all of CA (US)

(73) Assignee: Ultimo Organization, Inc., Santa Ana, CA (US)

( * ) Notice: Subject to any disclaimer, the term of this patent is extended or adjusted under 35 U.S.C. 154(b) by 0 days.

(21) Appl. No.: 09/392,080

(22) Filed: Sep. 8, 1999

(51) Int. Cl.[7] ..... B21F 9/00

(52) U.S. Cl. ..... 254/228; 254/263; 254/30; 298/2; 298/5; 294/114; 414/451

(58) Field of Search ..... 254/199, 228, 254/229, 230, 231, 234, 245, 246, 250, 251, 253, 254, 259, 263, 29 R, 30, 133 R; 294/113, 114, 110.2, 115, 116, 164, 165; 414/444, 450, 451; 298/2, 5

(56) References Cited

U.S. PATENT DOCUMENTS

| | | | | |
|---|---|---|---|---|
| 62,404 | * | 2/1867 | Gile et al. | 254/30 |
| 996,259 | * | 6/1911 | Kern | 254/29 R |
| 2,303,312 | * | 11/1942 | Sheffield | 254/29 R |
| 2,592,168 | * | 4/1952 | Morris et al. | 254/30 |
| 3,317,185 | * | 5/1967 | Burk et al. | 254/30 |
| 3,363,787 | * | 1/1968 | Macomber | 298/5 |
| 3,499,658 | * | 3/1970 | Fernholz et al. | 298/5 |
| 3,647,185 | | 3/1972 | Phibbs . | |
| 3,748,702 | | 7/1973 | Brown . | |
| 3,776,586 | * | 12/1973 | Ahlgren et al. | 294/114 |
| 3,854,645 | | 12/1974 | Knights . | |
| 3,998,063 | | 12/1976 | Harders . | |
| 4,051,988 | | 10/1977 | Egerstrom et al. . | |
| 4,256,286 | | 3/1981 | Hudgins . | |
| 4,354,706 | | 10/1982 | Coyle . | |
| 4,371,018 | * | 2/1983 | Arnold | 254/30 |
| 4,706,935 | | 11/1987 | Thompson . | |
| 4,715,456 | | 12/1987 | Poe et al. . | |
| 4,793,623 | * | 12/1988 | Talbot | 298/5 |
| 4,804,165 | | 2/1989 | Pippin et al. . | |
| 4,822,006 | | 4/1989 | McIntire . | |
| 4,890,671 | | 1/1990 | Baxter . | |
| 4,925,159 | | 5/1990 | Younes . | |
| 5,311,937 | | 5/1994 | Masaki et al. . | |
| 5,335,756 | | 8/1994 | Penisson . | |
| 5,492,437 | * | 2/1996 | Ortiz | 254/29 R |
| 5,848,647 | | 12/1998 | Webre . | |

FOREIGN PATENT DOCUMENTS

| | | | | |
|---|---|---|---|---|
| 5509 | * | 10/1901 | (AT) | 294/113 |

OTHER PUBLICATIONS

Diamond Drill Contracting Company, Ultra–Pull Rod and Casing Pullers—Product Specifications, 1995, pp. 1–4, Spokane, WA USA.

Rhino Tool Company, Rhino Post Puller Model PL–3—Product Specification, 1993, pp. 1–2, Kewanee, IL USA.

* cited by examiner

*Primary Examiner*—Emmanuel M. Marcelo
(74) *Attorney, Agent, or Firm*—Glenn R. Smith

(57) ABSTRACT

A portable extraction tool facilitates soil stabilization applications that utilize compaction grouting. Compaction grouting involves installing grout injection casing into the ground in fixed-length sections to depths limited by soil compaction or bedrock. The casing is then removed in stages. Between stages, grout is pumped through the casing and into the soil at high pressure. The extraction tool provides the power, gripping strength, stability and operator control required to pull casings from the ground at a desired rate. Pulling power is provided by a pair of hydraulic cylinders. Gripping strength is provided by a progressive chuck mechanism that secures injection casings on upward movements of the cylinders and releases casings on downward movements, without damaging the reusable casings. Stability and strength are provided by a heavy, large-footprint base plate. The base plate and chuck have aligned, open-face slots to provide easy positioning of the tool on installed casings and to utilize casings for lateral support. Inherent tool stability and multiple integrated steps allow a person to safely stand on the tool. This enables an operator to monitor a grout pressure gauge and pump stroke counter and to perform casing disassembly high above the tool, eliminating the need for external ladders or platforms. The tool is provided with turf tires and a handle and designed to be easily moved and operated in rough earth and limited access conditions by one or two persons. The tires are suspended above ground in the tool operating position to avoid destabilizing the tool.

18 Claims, 16 Drawing Sheets

PORTABLE INJECTION-CASING EXTRACTOR

BACKGROUND OF THE INVENTION

Geological grouting is a versatile construction technique used in a variety of applications. Injection casing or piping is driven into the ground. Grout is then pumped under pressure through the above-ground end of the installed casing, out the underground end, and into the surrounding soil. The grout itself can be made from many different materials proportioned in a wide range of amounts depending on the specific grouting application. Cementitious grout, for example, is a mixture of hydraulic cement and water, with or without aggregates and with or without admixtures. Hydraulic cements react with water to form a hardened paste that maintains its strength and durability in water and also maintains its properties upon drying.

Grouting applications include slabjacking, subsealing and soil grouting. In slabjacking, pressure grouting is used to raise a depressed section of pavement or other concrete element by forcing a flowable grout under it. Subsealing is where a cement-grout mixture is pumped under pressure through a packer installed in an access hole drilled in a slab to fill voids and depressions under the slab and reduce damage caused by excessive pavement deflections. For soil grouting, soil is grouted to increase its bearing capacity, reduce or halt settlement, increase shear resistance to stabilize it against lateral movement, reduce waterflow, or increase the cohesive strength of friable ground prior to excavation. Soil grouting includes permeation grouting, where a thin grout is used to permeate the soil and fill pores and voids between soil particles; deep-soil mixing, where soil and injected grout are mixed together to make a soil-cement material in place; jet grouting, where a cement-and-water grout is injected under very high pressure to form a concrete-like column; and compaction grouting, described below.

Compaction grouting is a soil stabilization process where weak or compromised sub-soils are re-compacted. This technique involves driving injection casing into the soil in five to eight foot sections until good refusal is achieved, usually when the casing reaches bedrock or bearing strata. Pressure grouting is then performed in vertical stages throughout the length of the casing hole. The vertical stages are created by extracting a section of casing a fixed length, typically one to three feet, and then pumping a quantity of stiff, sand-and-cement grout through the casings. An operator monitors an external pressure gauge and pump stroke counter at a pump head attached to the casing end. The operator also records the pressures achieved and the quantity of grout injected at each stage. A fully extracted section of casing is removed between stages, the pump head is reattached, and the extraction and grouting sequence is repeated. The stiff grout does not permeate the soil but maintains a grouted mass, three feet or more in diameter. By displacing the soil and forming a bulblike or columnlike form, the grout significantly increases the soil density at a radial distance of one to six feet or more from the soil-grout interface.

SUMMARY OF THE INVENTION

In compaction grouting applications, injection casings are essentially nailed into the ground and require great power and lift capability to extract. Thus, an effective tool and method of extracting injection casings between stages of grout pumping is required. Prior devices for pulling elongated objects from the ground typically suffer from limitations in the areas of transportability, strength, grip effectiveness, casing reusability and stability that severely hamper their overall effectiveness for compaction grouting. The portable injectioncasing extractor apparatus and method according to the present invention provides injection casing extraction capability in compaction grouting applications without these limitations.

For example, pulling devices typically suffer from a combination of insufficient lifting power and structural strength to meet the demands of many compaction grouting jobs, resulting in frequent failure and breakdowns. Further, the puller chucking mechanisms used to secure elongated objects to a lifting device frequently require multiple manual operations to engage and disengage, greatly slowing an extraction process conducted in stages. Some puller chucking mechanisms also lack gripping strength or tend to damage casing by denting, gouging or crushing the casing wall.

By contrast, the portable injection-casing extractor apparatus and method ("extraction tool") according to the present invention has dual hydraulic cylinders for a lifting force capable of pulling sections of grout injection casing out of the ground at an operator-controlled rate. A heavy-duty base plate and chassis provide the structural strength to support operation of the dual cylinders. The cylinders are powered by a remote hydraulic power unit or "mule." The cylinders have an attached progressive chuck mechanism that provides sure engagement of the injection casing at the beginning of a lifting stage and release at the end of a lifting stage, without manual intervention between stages or the use of complex automatic control mechanisms. The amount of force applied to casing walls by the progressive chuck is self-limiting, protecting the casings from damage. The teeth of the progressive chuck are advantageously maintained generally flush to the casing wall during gripping and extraction steps, which avoids gouging, denting and crushing movements that would also damage the casings. These features advantageously allow casings to be reused after removal by the extraction tool.

Further, pulling devices are often awkward to transport to a construction site. If wheels are provided for transportation, they are in contact with the ground at all times, creating extractor instability during operation. Further, these devices are frequently difficult to position on installed casings. Operators are often required to lift a heavy pulling device and place it over the end of an installed casing that is protruding from the ground. In addition, these devices typically require external ladders and steps for the tool operator to remove casing sections and to disassemble, reassemble and monitor the pump head and gauges located high above the tool.

The extraction tool according to the present invention is compact for limited access applications, and, being mounted on turf tires, the tool is easily moved and operated by one or two workers in typically rough terrain conditions. An integrated handle facilitates transporting and positioning of the tool and allows sufficient leverage for a single operator to move the tool between its operating position and its transport position. The tool is so well-balanced and stable that it can maintain either its operating position or its transport position without operator support. An open-face base plate and chuck design allows the tool to be rolled into position on injection casings without lifting the tool. The installed injection casings held within the open-face base plate and chuck also provide lateral support for the tool, further increasing its stability. The weight and balance of the extraction tool provide sufficient stability for adult male to safely stand on tool. Integrated steps and platforms provide operator access to locations high above the tool. These features allow an operator to disassemble casing sections, disassemble and reassemble the pumping hose connection and to monitor pressure and stroke gauges at the casing end without the need for external platforms and ladders. The turf tires are offset from the ground in the tool's operating position, also enhancing its stability.

One aspect of the present invention is an extraction tool for progressively jacking a shaft from its surrounding media. The extraction tool has a lift with a stationary end and a moveable end, a block assembly attached to the moveable end, and a plurality of opposing grips. The block assembly defines an interior space configured to accommodate the shaft. The grips can be positioned within the interior space in contact with the shaft. The grips are configured to have loose and tight positions around the shaft. As the lift extends, the grips move from the loose to the tight position, securing the shaft to the block assembly. As the lift retracts, the grips move from the tight to the loose position, releasing the shaft from the block assembly.

In a particular embodiment, the grips have a plurality of tooth rows which are positioned flush against the shaft while the grips are in either the loose or tight positions. In another particular embodiment, the block assembly has a pair of chuck blocks and the grips are a pair of wedges corresponding to the pair of chuck blocks. The chuck blocks each having an angular face generally facing and sloping away from the interior space. The wedges each have a first face, an opposite second face and a wide end between the first and second faces. Each of said wedge first faces contacts and slides against a corresponding block angular face, so that as the lift extends the blocks move relatively toward the wide ends of the wedges and move the wedges from an loose to a tight position. A particular angle between the wedge faces is in the range of 12 to 20 degrees. The extraction tool may include a hinge attached to the block assembly. One end of a retainer is rotatably attached to the hinge and a grip is rotatably mounted to the other end of the retainer. In this manner, the grip is retained by the block assembly and can be moved from an open position outside of the block assembly to a closed position within the interior space.

Another aspect of the present invention is a method of extracting an installed shaft from its surrounding media, the shaft having a protruding end extending from the media. A lift is positioned near the protruding shaft end. The lift has a moveable end and a stationary end. The surrounding media supports the lift stationary end and the lift moveable end supports a chuck. A first portion of the shaft protruding end is loaded into the chuck and a grip is positioned near the first shaft portion. A gripping element mounted on the grip is positioned so that its surface is in flush contact with the first shaft portion. Extension of the lift moveable end is initiated and, in response, the grip secures the shaft portion. Extension of the lift is completed with the shaft portion secured to the chuck, at least partially removing the shaft from its surrounding media. Retraction of the lift moveable end is initiated, releasing the shaft portion from the grip in response. Retraction of the lift moveable end is completed with the shaft portion released from the chuck and the chuck is positioned on a second shaft portion of the protruding end nearer the media from the first shaft portion.

In a particular embodiment, the gripping element surface is a toothed face having a plurality of tooth rows. In another particular embodiment, the grip secures the shaft portion by translating initial extension of the lift into an initial movement of the grip against the first shaft portion. In yet another particular embodiment, the grip is a wedge and the translating step involves initiating movement of an angular block portion of the chuck relative to the wedge in a direction from a narrow end to a wide end of the wedge, increasing pressure of a wedge face containing the gripping element against the shaft portion. In still another particular embodiment, the grip is a wedge and the releasing step involves initiating movement of an angular block portion of the chuck relative to the wedge in a direction from a wide end of the wedge to a narrow end of the wedge, reducing pressure of a wedge face containing the gripping element from the shaft portion.

Yet another aspect of the present invention is an extraction tool having an operating position and a transport position. The tool has a generally planar base plate with a first face, an opposite second face and a back edge between the first and second faces, where the first face contacts the ground and the second face is opposite the ground in the tool's operating position. The tool also has a frame attached to the back edge that extends generally perpendicularly away from the second face. Tires are mounted on each side of said frame and offset from the ground in the operating position. The tires and the back edge contact the ground in the transport position so that the tool is stable and self-standing in both its operating and transport positions. The tool further has a chuck moveably mounted to the base plate.

In a particular embodiment, the extraction tool also has a handle attached to the frame and extending generally perpendicularly away from the second face. The handle provides leverage for moving the tool between the operating and transport positions. In another particular embodiment, the extraction tool also has a number of integrated steps, at least one step is located on each of the frame and the handle. The base plate has a sufficient weight and footprint so that the tool can support a person standing on any of the steps without external support for the tool. In a specific embodiment, the weight of the base plate is at least about 90 pounds and the footprint of the base plate is at least about 470 square inches. In yet another particular embodiment, both the base plate and the chuck have an open-face slot configured to accommodate shafts.

An additional aspect of the present invention is an extraction tool having a base means for supporting the tool, a lift means for extending and retracting a chuck plate and a progressive chuck means for securing a shaft as the chuck plate is extended and for releasing a shaft as the chuck plate is retracted. The lift means is mounted to the base means and the chuck means is mounted to the chuck plate. The extraction tool may also have a plurality of step means for supporting a person standing on the tool. The extraction tool may also have an open-face means for loading and retaining shafts within the chuck means. The extraction tool may also have a transport means for moving the tool. Also, the extraction tool may have a handle means for positioning the tool.

DETAILED DESCRIPTION OF THE PREFERRED EMBODIMENTS

Figure 1:
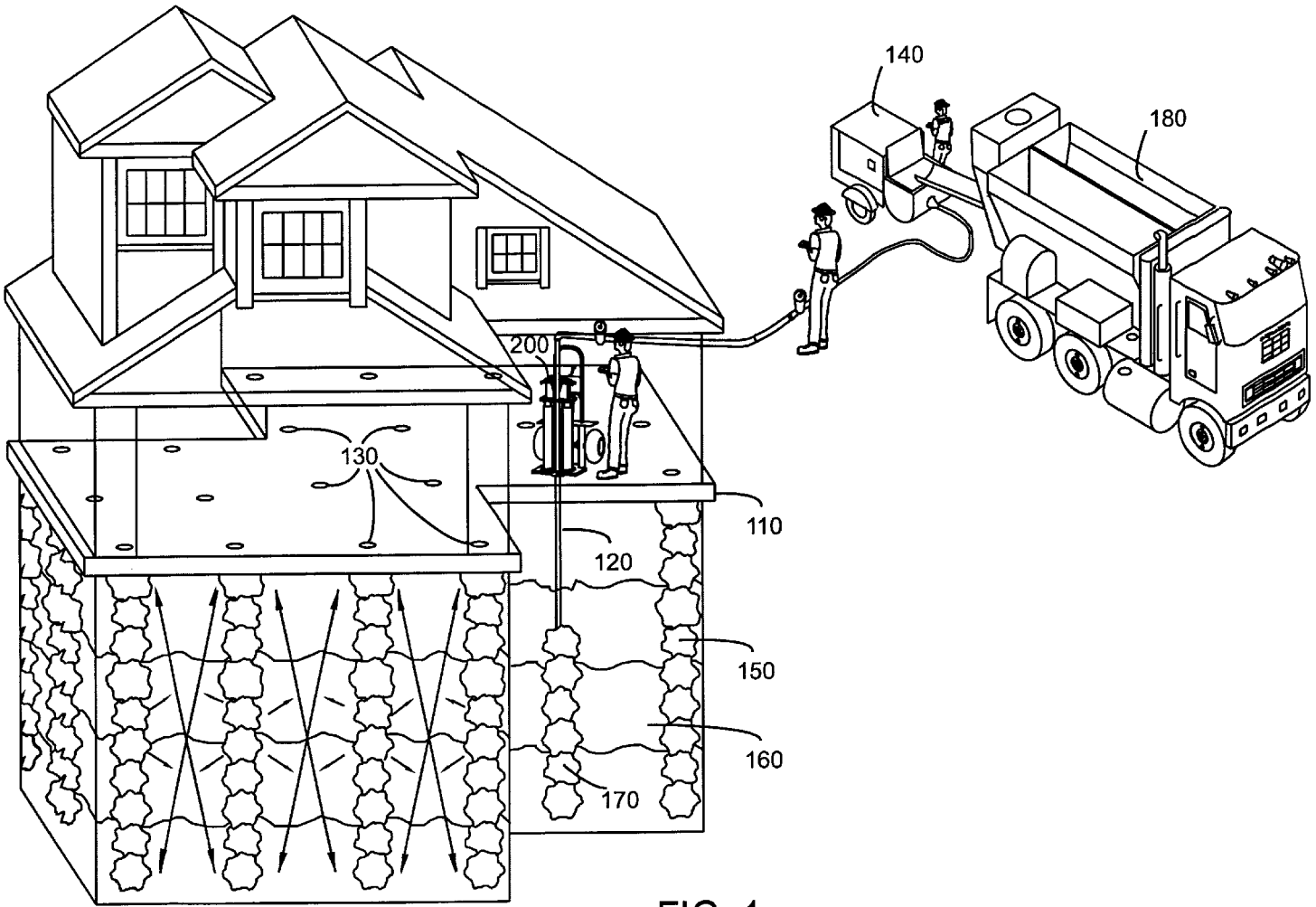
FIG. 1 is an illustration of compaction grouting under a foundation utilizing a portable injection-casing extractor apparatus and method ("extraction tool") according to the present invention.

FIG. 1 illustrates compaction grouting under a foundation 110. Injection casings 120, generally 1½" to 2" in diameter, are driven down in a grid pattern 130 to bearing strata. An extraction tool 200 according to the present invention is positioned on an injection casing, extracting the casing in stages. A mobile grout plant 180 feeds a high pressure grout pump 140 on the surface. The pump 140 injects cementitious grout into the casings 120 between stages of casing extraction, building a vertical column 170 of grout balls. A completed grout column 150 causes radial densification of the surrounding soil particles 160. The operator monitors an external pressure gauge and pump stroke counter at each lifted stage of pumping and, upon completion of extracting one section of injection casing, disconnects the pumping head and spent section of injection casing.

Figure 2A:
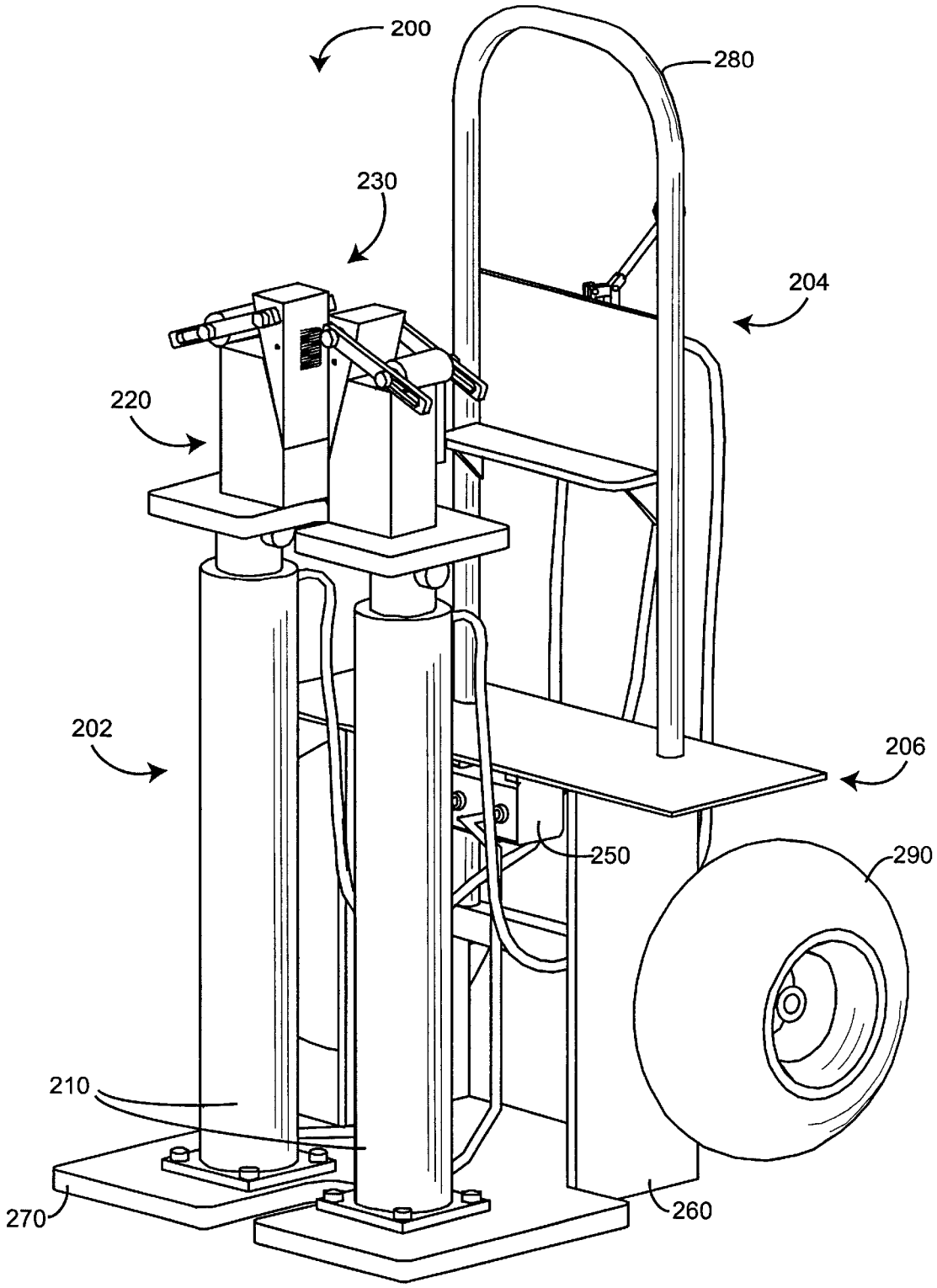
FIG. 2A is a front perspective view of an extraction tool embodiment shown in its operating position.
Figure 2B:
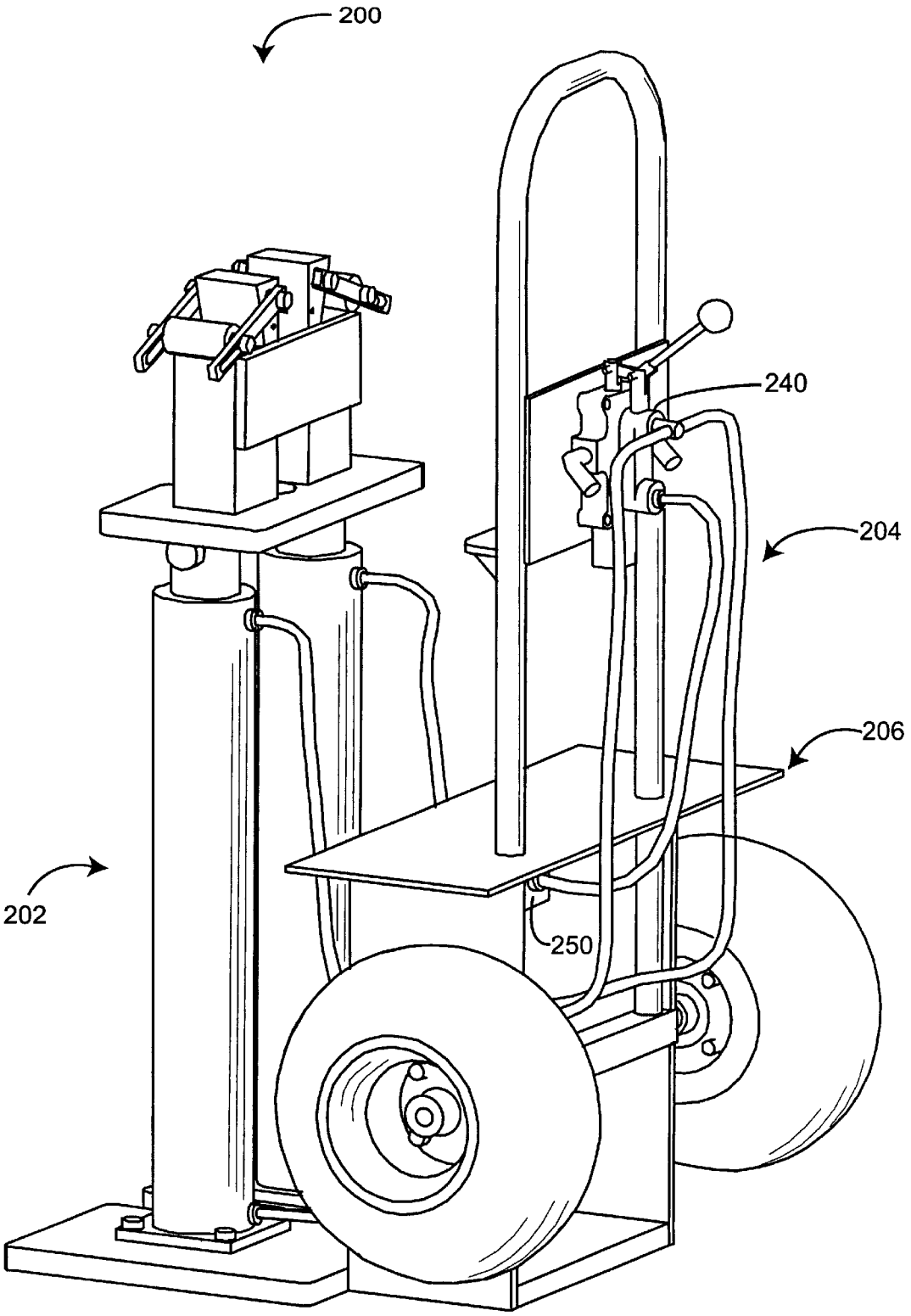
FIG. 2B is a back perspective view of an extraction tool embodiment.

FIGS. 2A and 2B illustrate front and back views, respectively, of one embodiment of an extraction tool 200 according to the present invention. As shown in FIGS. 2A and 2B, the extraction tool 200 is constructed of an extractor assembly 202 driven by a hydraulic control assembly 204 and integrated with a tire-mounted chassis 206. As shown in FIG. 2A, the extractor assembly 202 has hydraulic cylinders 210, a chuck block assembly 220 and a gripping assembly 230. Also shown in FIG. 2A, the chassis 206 has a machine frame 260, a base plate 270, a handle 280 and a wheel assembly 290. Shown in FIG. 2B, the hydraulic control assembly 206 has a hydraulic control valve 240 and a hydraulic flow divider 250 (see also FIG. 2A).

In compaction grouting applications, the hydraulic force needed to compact the sub-soils may also grip the injection casings. Thus, it is desirable for the extraction tool 200 (FIG. 2A) to be capable of applying substantial pulling force to the casings. In the extraction tool embodiment shown in FIG. 2A, this pulling force is supplied by dual hydraulic cylinders 210 acting in unison. Suitable hydraulic cylinders 210 are CHIEFWP brand cylinders, part number 4024WP, available from Bailey Manufacturing Corp., Knoxville, Tenn. These cylinders 210 each have a 24" stroke, a 2" rod, a 4" bore and operate with a hydraulic pressure up to 3000 psi.

Although FIGS. 2A–B illustrate an embodiment utilizing dual hydraulic cylinders positioned on either side of an injection casing (see also FIGS. 10A–D), one of ordinary skill will recognize other embodiments within the scope of the present invention having fewer or more cylinders. For example, a single cylinder configured to accommodate an injection casing through a hollow core or any number of multiple cylinders evenly positioned around an injection casing would also provide a balanced pulling force to the casings. Further, it would be obvious to one of ordinary skill that other embodiments employing any apparatus that generates a pulling or lifting force, including the powered hydraulic cylinders shown in FIGS. 2A–B in addition to manual or power-driven jacks, gears and screws (generally "lifts") are within the scope of the present invention.

Figure 2C:
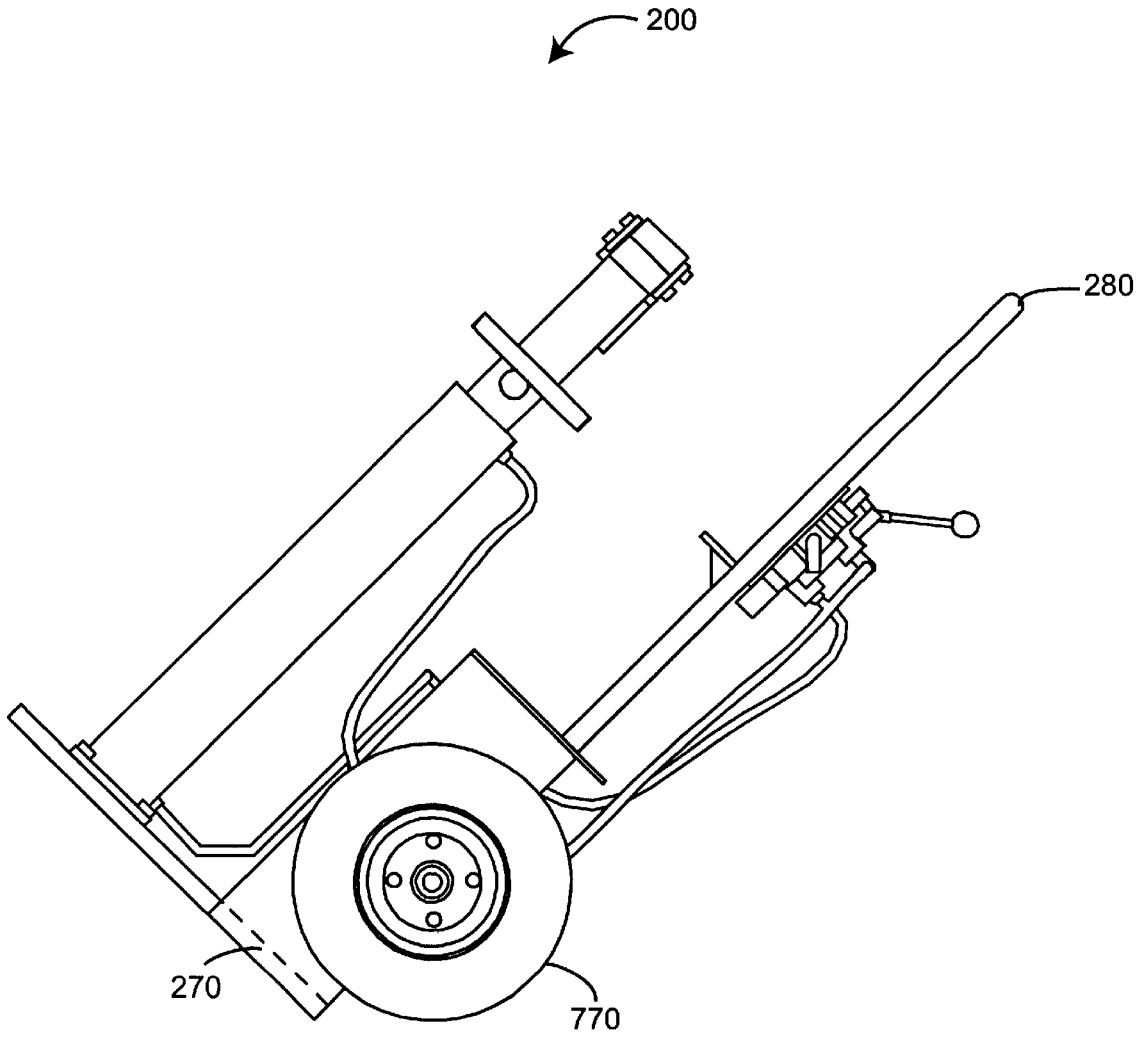
FIG. 2C is a perspective view of an extraction tool embodiment shown in its transport position.

FIG. 2C shows the extraction tool 200 in its transport position. The tool 200 is easily moved by one person between its operating position (FIG. 2A) and this transport position. Further, the tool 200 will maintain this transport position without operator support, resting on the base plate 270 and tires 770. In this manner, the tool 200 is portable, easily transportable, and can be moved and operated by one or two persons in limited access areas. These advantageous transport features are the result of a balance between the base plate 270 weight, leverage available from the handle 280 and the chassis height 704 (FIG. 7A), and the clearance 790 (FIG. 7B) between the tires 770 (FIG. 7B) and ground in the tool's operating position, specifics of which are given below.

Figure 3:
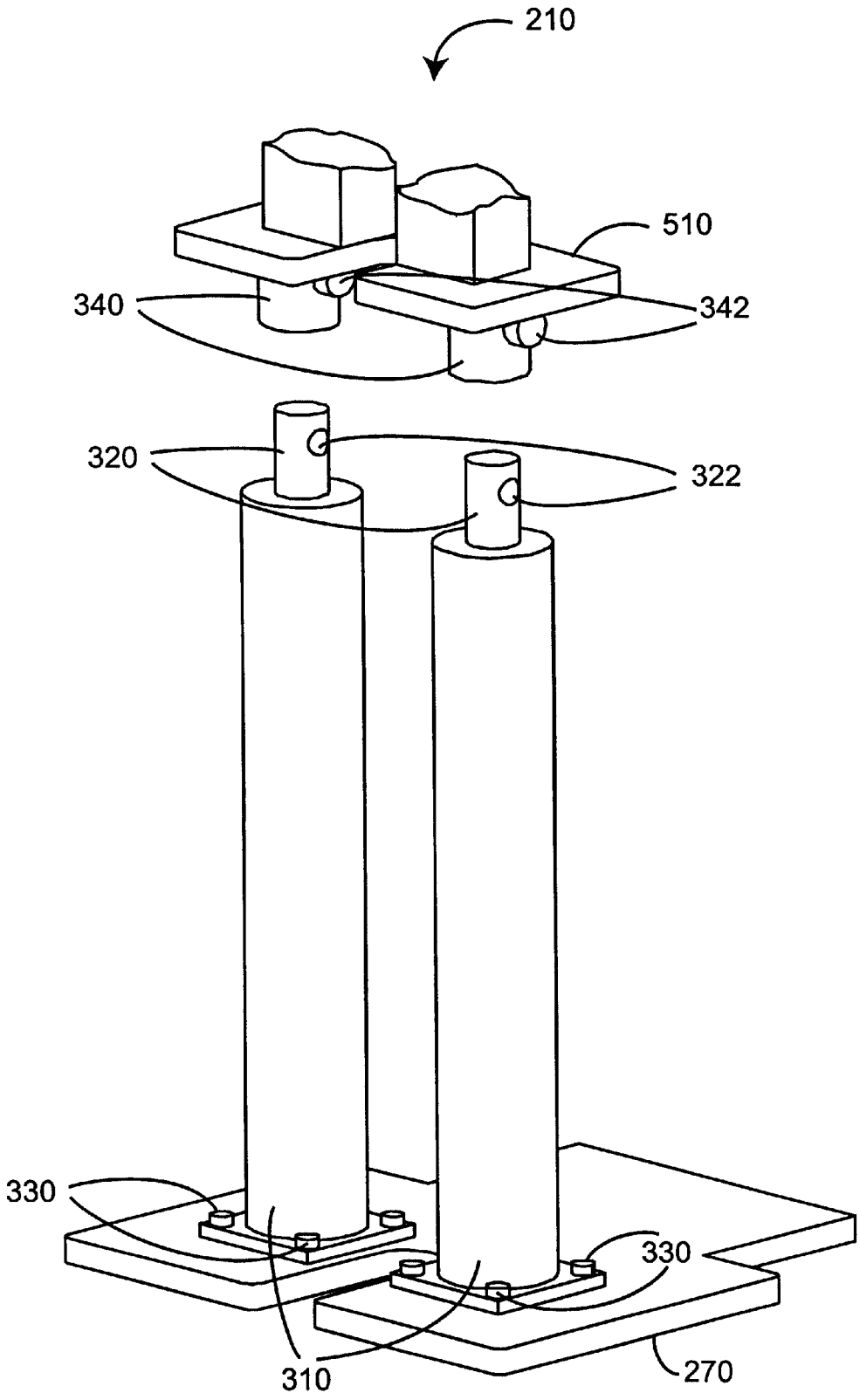
FIG. 3 is an exploded view of the hydraulic cylinder rods and mounting sleeves.

As illustrated in FIG. 3, the hydraulic cylinders 210 have stationary ends 310 and moveable ends 320. To accommodate the force applied by the cylinders 210, the stationary ends 310 of the cylinders 210 are mounted on a heavy duty chassis base plate 270 (see also FIG. 4) and secured with conventional ⅝"×1½" bolts 330. The moveable ends 320 of the cylinders 210 are attached to a chuck base plate 510 (see also FIG. 5) with conventional 1"×3½" bolts 342 threaded through chuck plate mounting sleeves 340 and holes 322 in the cylinder moveable ends 320. In an alternative embodiment, the cylinders can be inverted so that the moveable ends 320 are attached to the chassis base plate 270 and the cylinder stationary ends 310 are attached to the chuck base plate 510. This advantageously allows the chuck assembly to be mounted to the cylinder walls, somewhat reducing the overall extended height of the extraction tool.

Figure 4:
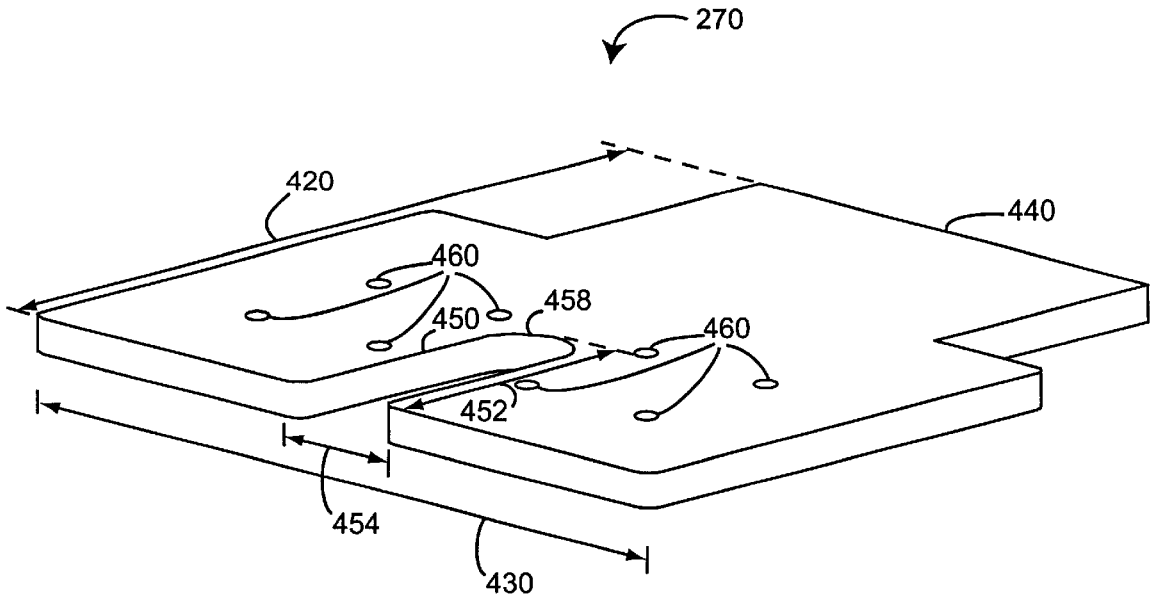
FIG. 4 is a perspective view of the chassis base plate.

FIG. 4 illustrates the chassis base plate 270. In addition to supporting the cylinders 210 (FIG. 3), the chassis base plate 270 functions to supply stability and balance to the extraction tool 200 (FIG. 2A), advantageously allowing the tool to safely support a person standing in various positions on the tool during operation, as described below with respect to FIG. 7A. During operation of the extraction tool 200 (FIG. 2A), the base plate 270 is positioned flush against the ground. The base plate 270 has substantial weight and a relatively large footprint, providing a stable low center-of-gravity for the tool and resistance to lateral movement. The large base plate footprint also prevents the tool from sinking into soft earth during application of its substantial pulling force. A further base plate feature is an open-face slot 450 that accommodates injection casing. This feature utilizes the casing to hold the extraction tool 200 (FIG. 2A) in place, providing further extraction tool stability. The open-face design also facilitates positioning the extraction tool 200 (FIG. 2A) on an installed casing by simply sliding the casing into the open-face slot 450, eliminating the need to lift a heavy extractor apparatus over the top of an installed casing.

In the embodiment illustrated in FIG. 4, the chassis base plate 270 is constructed of 1" thick hot rolled steel and weighs approximately 90 pounds. The base plate 270 has a 23" depth 420; a 23" front width 430 and a 15½" back width 440. Ignoring the open-face slot 450, the base plate has an area of approximately 470 sq. in. The open-face slot 450 has a 7-¾" length 452 and a 3" width 454. The slot 450 ends in a semi-circular shape 458 having a diameter matching the slot width 454. The dimensions of the open-face slot 450 advantageously accommodate 1-½" schedule 80 injection casings having 2⅛" outer diameters. These casings are loose enough so that the tool 200 is easy to position on the casings, yet tight enough so that the casings provide support and stability to the tool. Mounting holes 460 are located in the face of the base plate 270 on either side of the slot 450 for attaching the dual hydraulic cylinders 210 (FIG. 3) to the base plate 270.

Figure 5:
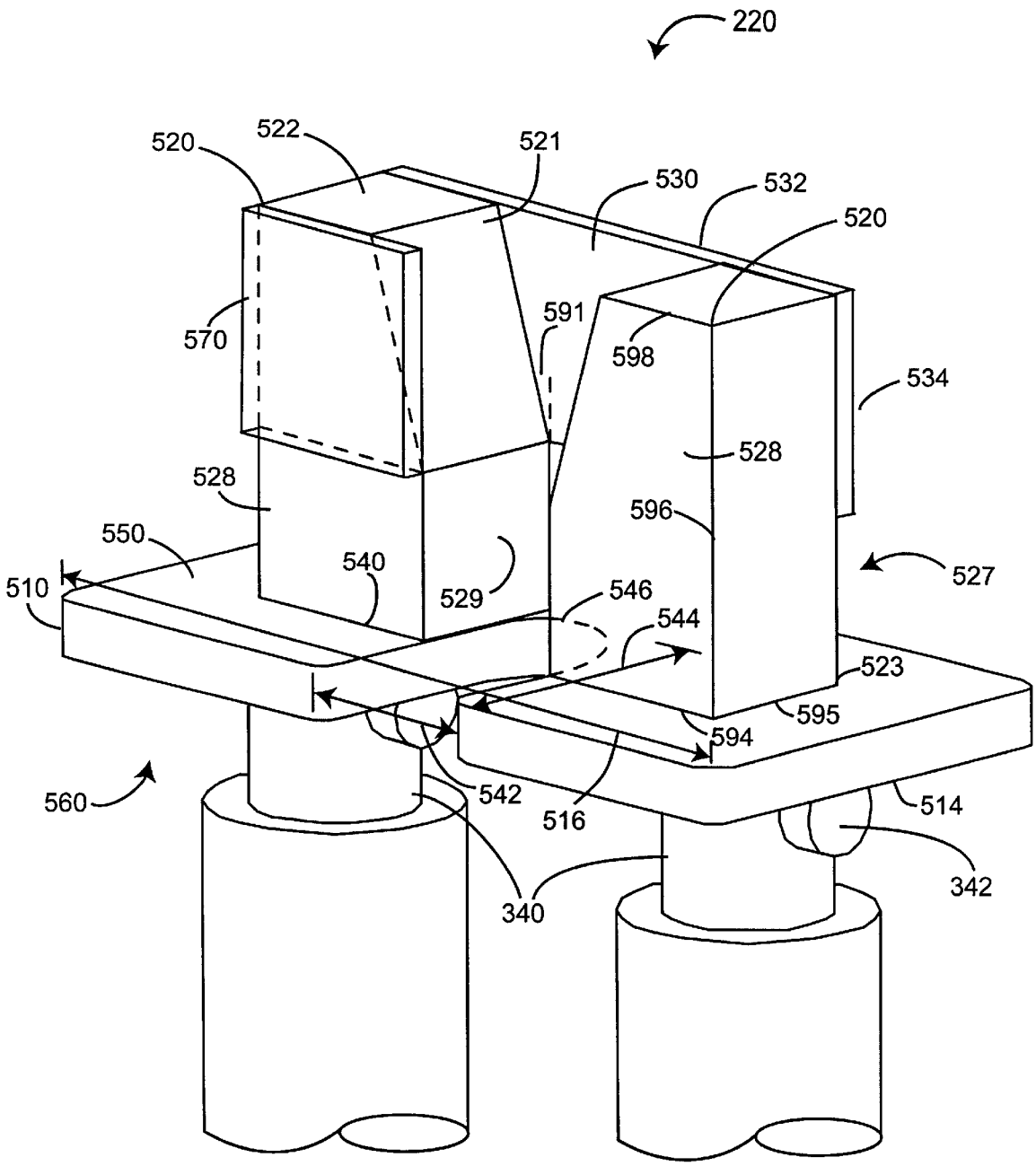
FIG. 5 is a perspective view of the chuck block assembly.

FIG. 5 illustrates further detail of the chuck block assembly 220. The chuck block assembly 220 retains and supports the gripping assembly 230 (FIG. 2A). The combination of the chuck block assembly 220 and the gripping assembly 230 (FIG. 2A) provides a progressive chuck mechanism that securely holds an injection casing during extension of the hydraulic cylinders 210 (FIG. 3) and that releases the injection casing upon retraction of the hydraulic cylinders 210 (FIG. 3). The chuck block assembly 220 has a chuck base plate 510, a pair of chuck blocks 520, a chuck back plate 530 and chuck front plates 570 (only one shown), which together define an interior space configured to accommodate casings and the gripping assembly 230 (FIG. 2A).

Shown in FIG. 5, the chuck base plate 510 has several functions. The chuck base plate 510 provides a connection to the hydraulic cylinder moveable ends 320. The chuck base plate 510 supports the remainder of the chuck block assembly 220 and the associated gripping assembly 230 (FIG. 2A). The chuck base plate 510 has an open-face slot 540 that accommodates injection casing, providing increased stability to the extraction tool 200 (FIG. 2A) in similar fashion to the chassis base plate 270 (FIG. 4), as described above with respect to FIG. 4. Further, the base plate top face 550 on either side of the chuck blocks 520 provides a step for a person to stand on the extraction tool 200 (FIG. 2A) during operation of the tool. In the embodiment shown in FIG. 5, the chuck base plate 510 is made of 1" thick hot rolled steel having a 6" depth 514 and an 18" width 516. The open-face slot 540 has a 3" width 542 and a 3½" depth 544, ending in a semi-circular shape with a diameter matching the slot width 542. Support sleeves 340 are welded to the base plate bottom face 560 and mounted on the cylinder moveable ends 320 (FIG. 3) as described above with respect to FIG. 3.

Also shown in FIG. 5, the chuck blocks 520 are machined with an angled face 521 at an angle 591 between 12° and 20° from the side face 529. In a particular embodiment, the angle 591 is 15° degrees. The block bases 523 each have a 4" width 594 and a 3" depth 595. The blocks 520 each have a 7" height 596. The block tops 522 have a 2" width 598 and a 3" depth 595.

FIG. 5 also shows that the chuck back plate 530 is welded to each back face 527 of the chuck blocks 520. The back plate 530 functions to add mechanical strength to the chuck blocks 520 and as a guide for positioning the wedges 810 (FIG. 8) of the gripping assembly 230 (FIG. 2A). The back plate 530 is made of ¼" thick cold or hot rolled steel and has a 11" length 532 a 5" height 534. In a particular embodiment, a separate front plate 570 is welded to each front face 528 of the chuck blocks 520 (only one front plate shown). Like the back plate 530, these front plates 570 function as a guide for positioning the wedges 810 (FIG. 8) of the gripping assembly 230 (FIG. 2A). Each front plate 570 is made of ¼" thick, 3"×4" cold or hot rolled steel.

Figure 6:
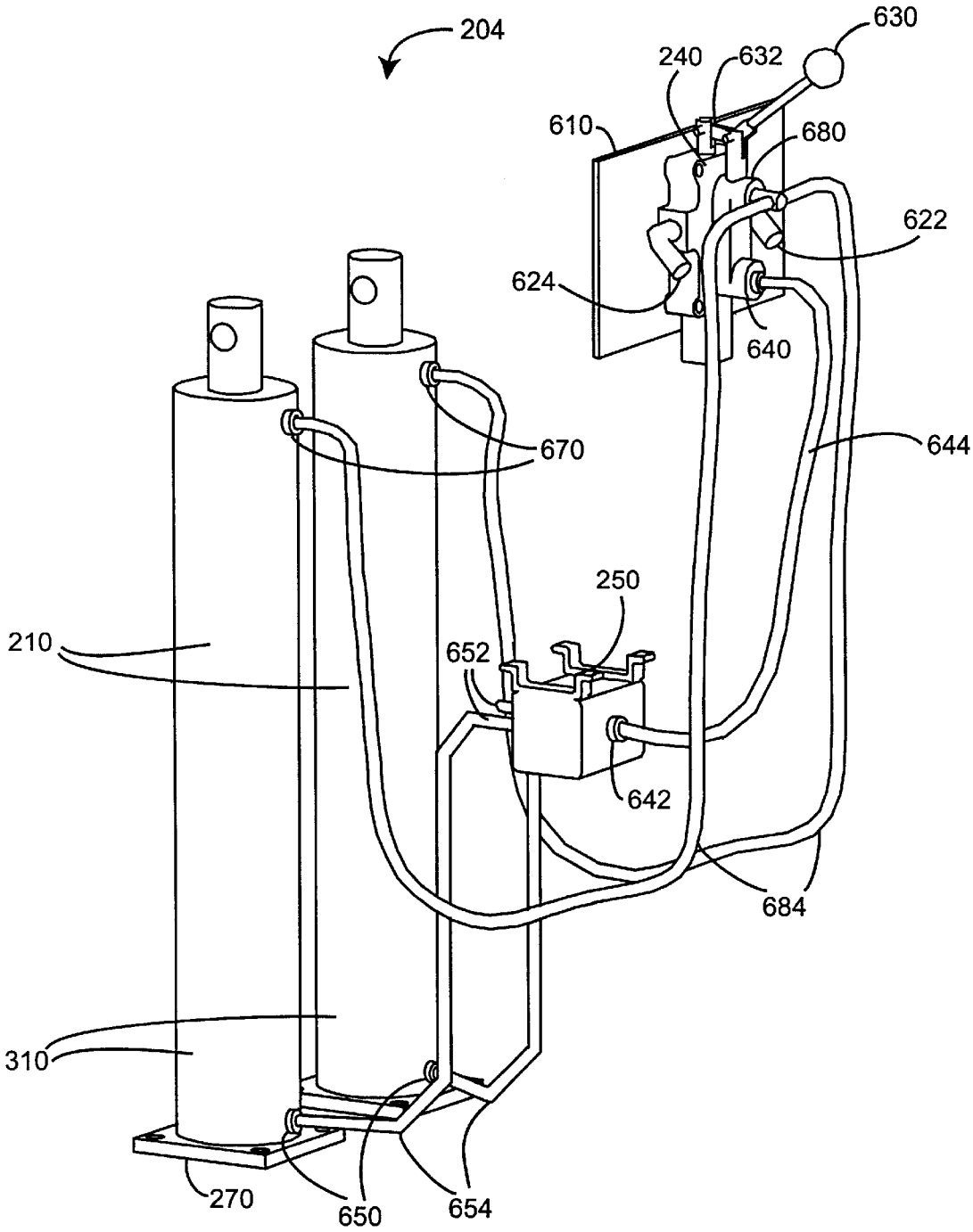
FIG. 6 is a perspective view of the hydraulic assembly.

FIG. 6 illustrates the hydraulic control assembly 204, which has a hydraulic valve 240 and a hydraulic flow distributor 250. The valve 240 is standard 4-way control valve rated at 20 gpm (gallons per minute), such as item number 2010-B596 available from Northern Hydraulics, Burnsville, Minn. The control valve 240 is bolted to a mounting plate 610, which, in turn, is welded to the handle 280 (FIG. 2A). The valve 240 has an input port 622 and an return port 624 for pressurized hydraulic fluid from an external hydraulic power unit or "mule" (not shown). The power unit provides hydraulic fluid to the extraction tool's dual cylinders 210 at nominally 1500–2500 psi and 8–16 gpm. Under control from a valve handle 630 that positions a valve switch 632, hydraulic flow from the input 622 is directed either to a first output port 640 or to a second output port 680.

Also shown in FIG. 6, a flow divider line 644 connects the first output port 640 to the flow divider input 642 of the flow divider 250. The flow divider 250 can be a two section, 9–18 gpm, rotary flow divider such as a Barns Hydraulics HALDEX brand device, item number 13006327 available from Bailey Manufacturing Corp., Knoxville, Tenn. The lower cylinder ports 650 are connected to the flow divider outputs 652 with the lower cylinder lines 654. When the valve handle 630 is in a first position, the flow divider 250 evenly distributes the hydraulic pressure between the lower cylinder ports 650, providing equal extension force in the two cylinders 210 during injection casing extraction.

FIG. 6 further shows the second output port 680 is connected to the upper cylinder ports 670 with the upper cylinder lines 684. When the valve handle 630 is in a second position, the control valve 240 directs pressurized hydraulic fluid to the upper cylinder ports 670, forcing retraction of the two cylinders 210 after a cycle of injection casing extraction, as described further below with respect to FIGS. 10A–D.

Figure 7A:
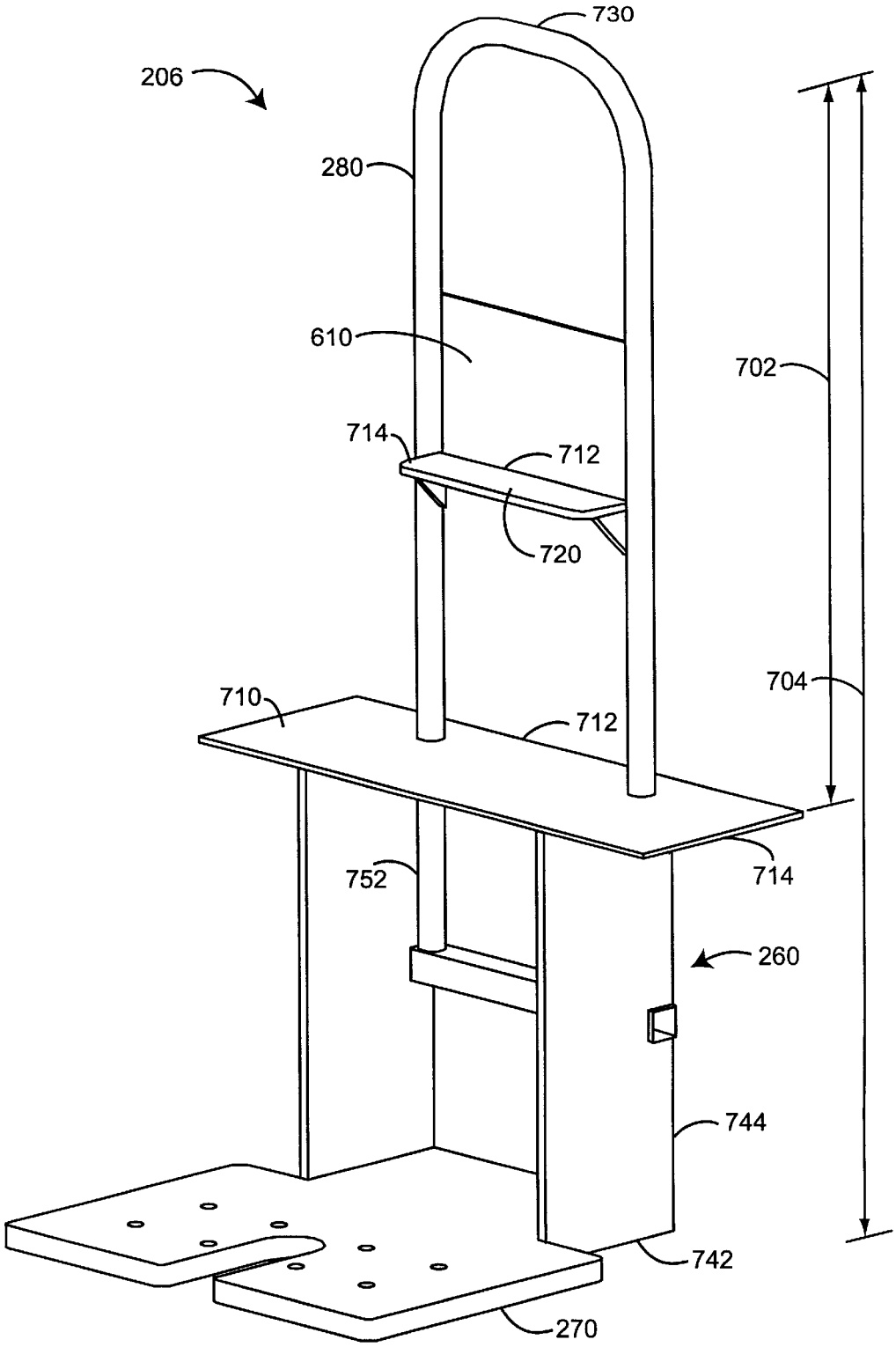
FIG. 7A is a perspective view of the chassis.

FIG. 7A illustrates the chassis 206, which has the machine frame 260, chassis base plate 270, and handle 280. The machine frame 260 is constructed of ½" thick hot rolled steel and has an 8" depth 742 and 20" height 744. The machine frame 260 is welded to the chassis base plate 270. Welded on top of the machine frame 260 is a platform 710 made of ¼" thick diamond plate having a 10" depth 714 and 28" width 712. The handle 280 is made of 1" steel pipe mounted through the platform 710. The handle 280 is welded to the platform 710 and to the machine frame 260 along the length of the handle portion 752 below the platform 710. The handle has a 34" length 702 above the platform 710 and a 9½" handle portion 752 below the platform 710. Including the handle 280, the chassis 206 has a 54" overall height 704. This advantageously provides sufficient leverage for an individual operator to move the tool 200 (FIG. 2A) between its operating position, shown in FIG. 2A, and its transport position, shown in FIG. 2C.

FIG. 7A also illustrates that the chassis 206 has a number of structurally integrated platforms and steps. These advantageously provide safe footing for a person who may be required to climb on the extraction tool 200 (FIG. 2A) to disassemble spent injection casings and the pumping head located at a position high above the extraction tool 200 (FIG. 2A). Further, during operation, a person may need to monitor pump pressure and stroke counts from meters which are also located high above the extraction tool 200 (FIG. 2A). The operator platform 710 was described above. Also, a first operator step 720 is welded to the handle 280, below the control valve mounting plate 610. The step 720 is constructed of ¼" thick diamond plate having a 3" depth 714 and a 13" width 712. In addition, a second operator step 730 is provided at the top of the handle 280. The second step 730 may be a diamond-hatched portion of the handle 280 or, alternatively, a small piece of ¼" thick diamond plate welded to the handle top to allow sure footing. The platform 710, first step 720 and second step 730, in addition to the chuck base plate face 550 (FIG. 5), all provide footing for a person climbing on the extraction tool 200 (FIG. 2A) to facilitate set-up and operation of injection casing extraction. The first step 720 and platform 710 also add structural strength to the chassis 206.

Figure 7B:
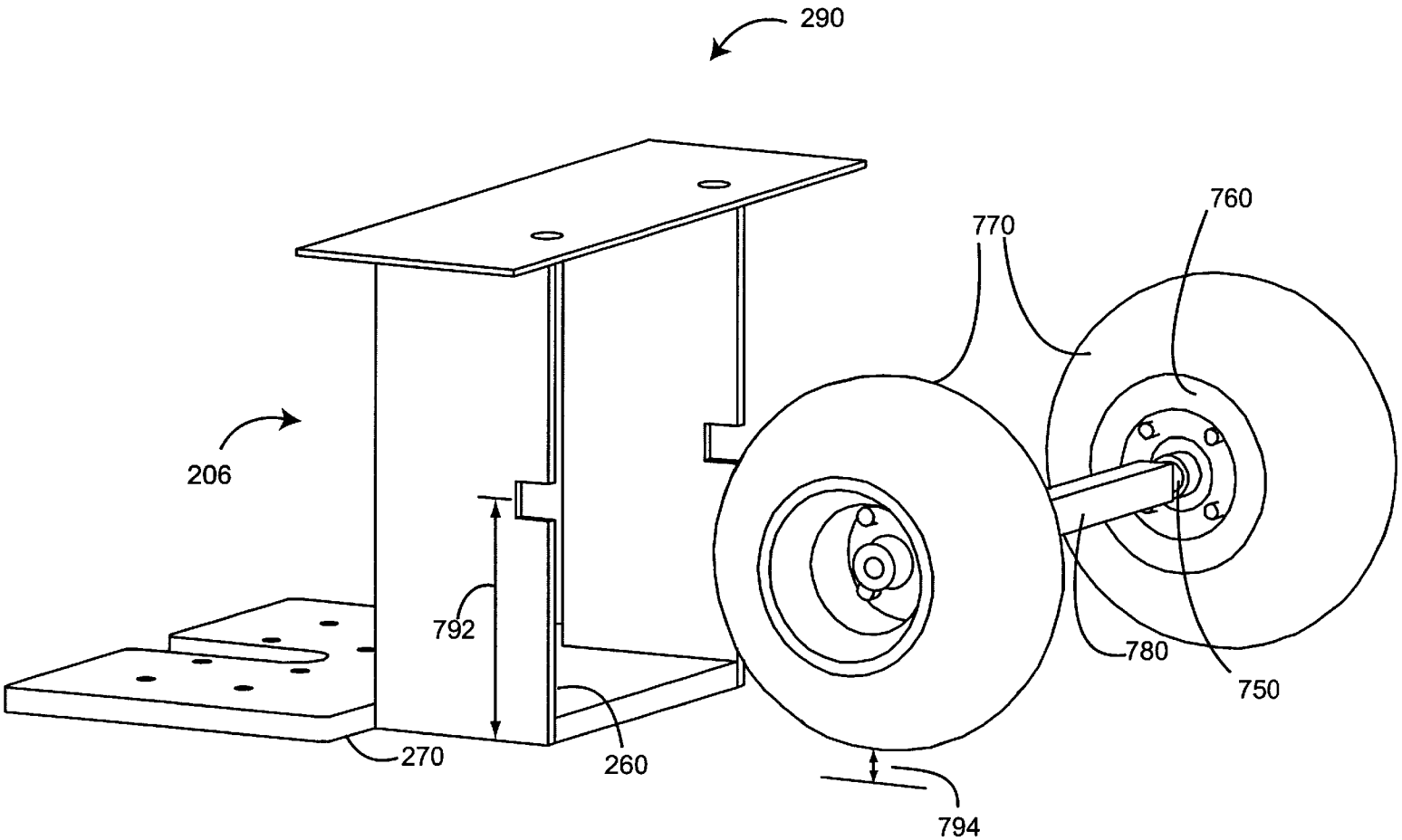
FIG. 7B is a perspective view of the wheel assembly.

FIG. 7B illustrates the wheel assembly portion 290 of the chassis 206. The wheel assembly 290 has turf tires 770 mounted onto wheels 760. The tires 770 are sized 18.5"× 8.5"×8", such as item number 1219-G051, available from Northern Hydraulics, Burnsville, Minn. The turf tires advantageously allow the extraction tool 200 (FIG. 2A) to be transported between casing locations over typically rough terrain conditions. Each wheel 760 is mounted onto an axle portion 750. These are available as an ATV Tire, Wheel, Hub and Axle Kit, item number 135012-G051, also from Northern. The axle portions 750 for each wheel are welded inside a 1½" square tubing 780, which is welded to the machine frame 260. Holes are drilled along a portion of the length of the tubing 780 to gain access inside the tubing 780 to weld the axle portions 750. The tubing 780 is advantageously mounted a 9" distance 792 above the chassis base plate 270. This provides a 1" clearance 794 between the tires 770 and the ground in the tool's operating position. This clearance 794 prevents tire contact with the ground during operation of the tool, which would tend to unstabilize the tool as an operator platform. The clearance 794 also allows the tool be maintained in the transport position (FIG. 2C) without operator support, i.e, with the tool stable while at rest on both the tires 770 and the back edge of the chassis base plate 270.

Figure 8:
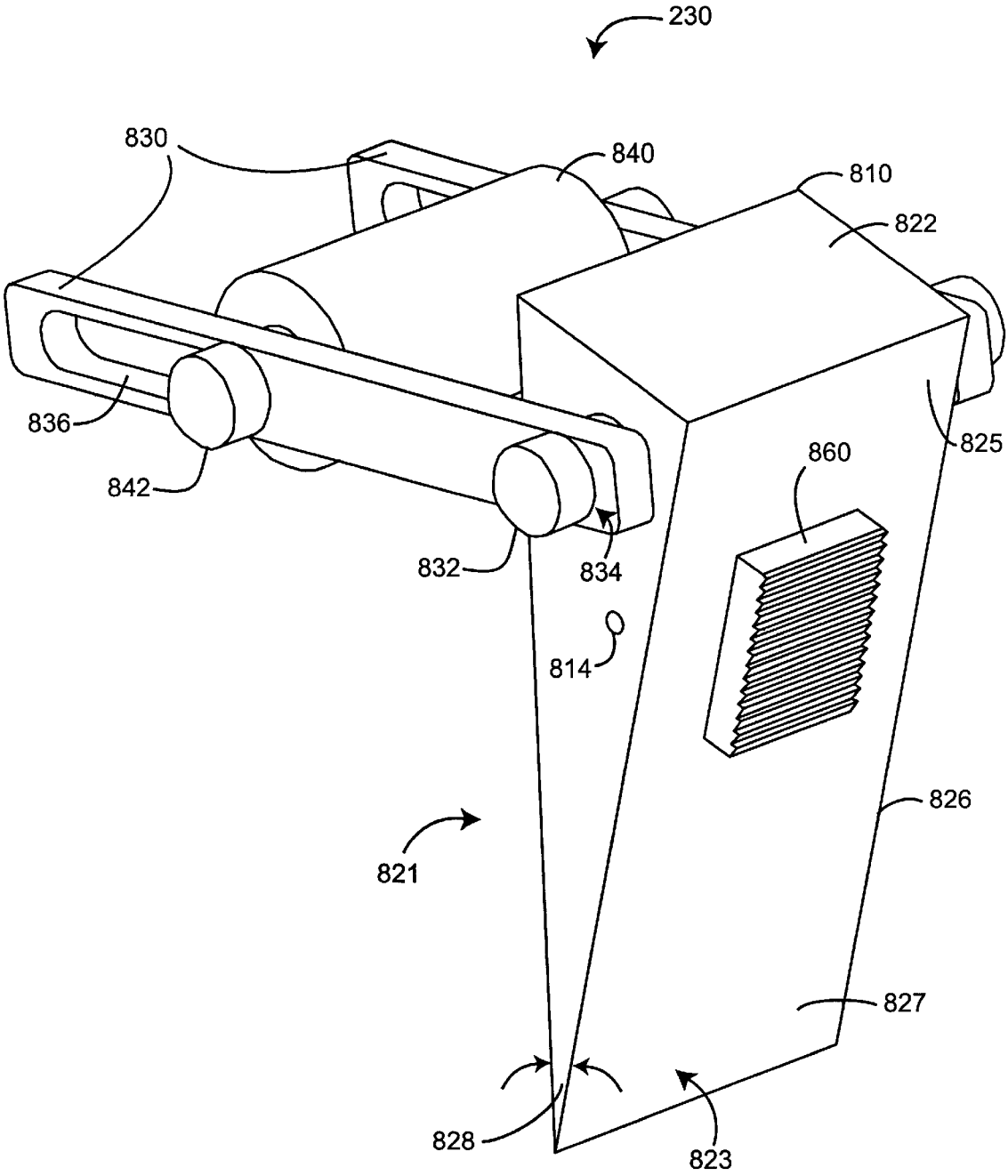
FIG. 8 is a perspective view of the gripping assembly.

FIG. 8 illustrates one of the two identical halves of the gripping assembly 230. The gripping assembly 230 has a wedge 810, wedge retainers 830, a hinge 840 and teeth 860. The hinge 840 is a 3" length of ½" wall pipe having a ⅝" opening. This pipe section is welded to a top face 522 (FIG. 5) of a corresponding chuck block 520 (FIG. 5). The wedge 810 is mounted between the wedge retainers 830 with a 3"×⅝" bolt assembly 832 mounted through a ⅝" retainer hole 834 (not visible) in each retainer 830 and a wedge through-hole 812 in the wedge 810. The wedge retainers 830, in turn, are attached to the hinge 840 with a 3×⅝" bolt assembly 842 mounted through the hinge 840 and adjustment slots 836 in the retainers 830. The ⅝"×2-⅝" adjustment slots 836 allow the wedge 810 to be aligned in contact with the chuck block angled face 521 (FIG. 5) and within the interior space between the chuck blocks 520 (FIG. 5).

Figure 9:
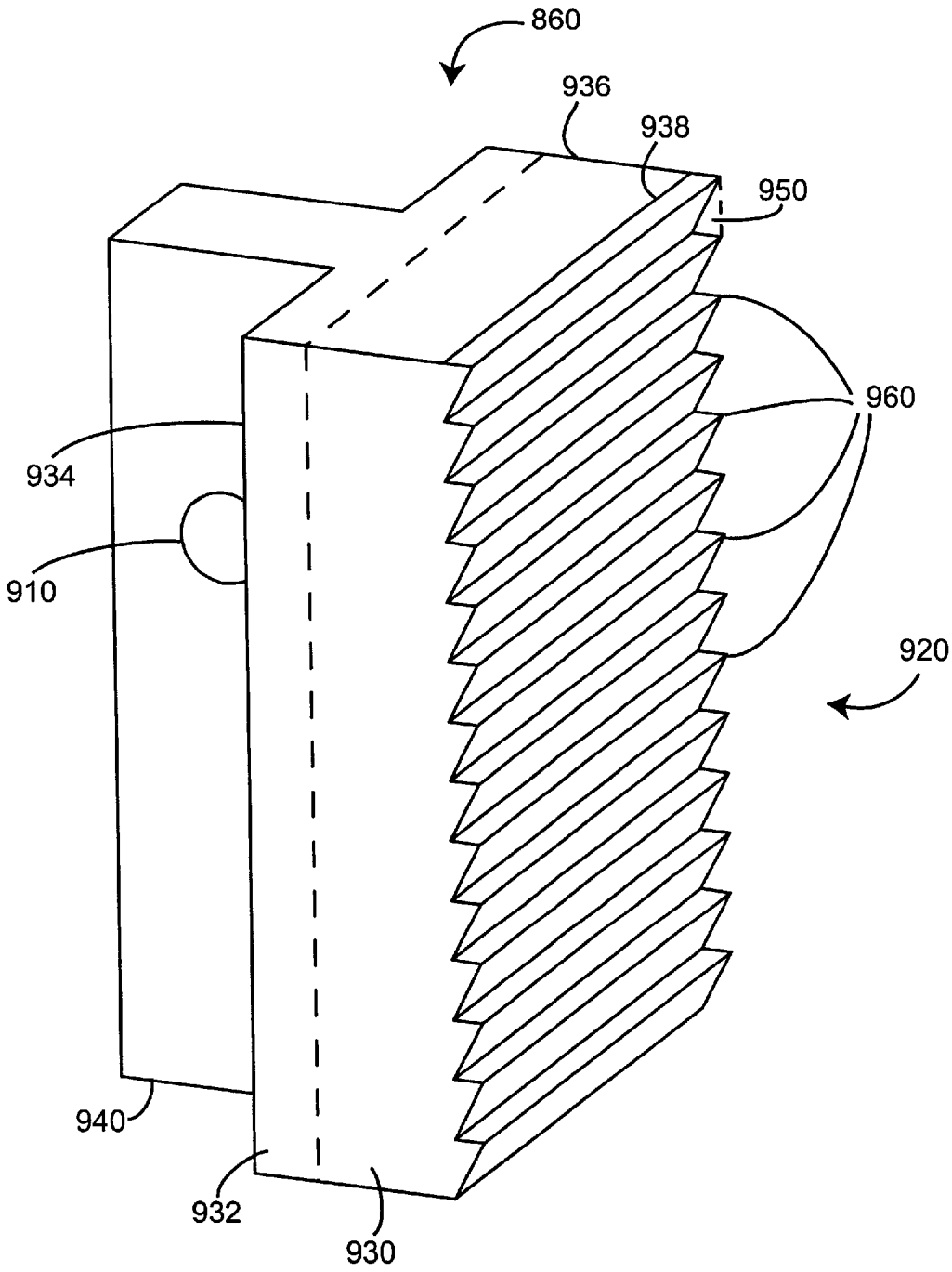
FIG. 9 is a perspective view of the gripping assembly teeth.

As shown in FIG. 8, the wedge 810 has an angled face 821 and a perpendicular face 823, both extending from a wedge wide-end 825 to a wedge narrow-end 827. The wedge 810 is machined from a bar of cold rolled steel. The wedge wide-end 825 has 2"×3" dimensions, and the wedge length 826 is 7". The angled face 821 is constructed at an angle 828 of between 12° and 20° with the perpendicular face 823 to match the angle 591 (FIG. 5) of the chuck block angled face 521 (FIG. 5). In a particular embodiment, the angle 828 is 15°. The teeth 860 are advantageously attached in a removable manner to the perpendicular face 823 via a pin (not shown) inserted through a 3/16" wedge pin hole 814 and through a teeth retaining hole 910 (FIG. 9). This allows the teeth, which can be dulled, damaged or broken during tool operation, to be readily replaced.

Figure 10A:
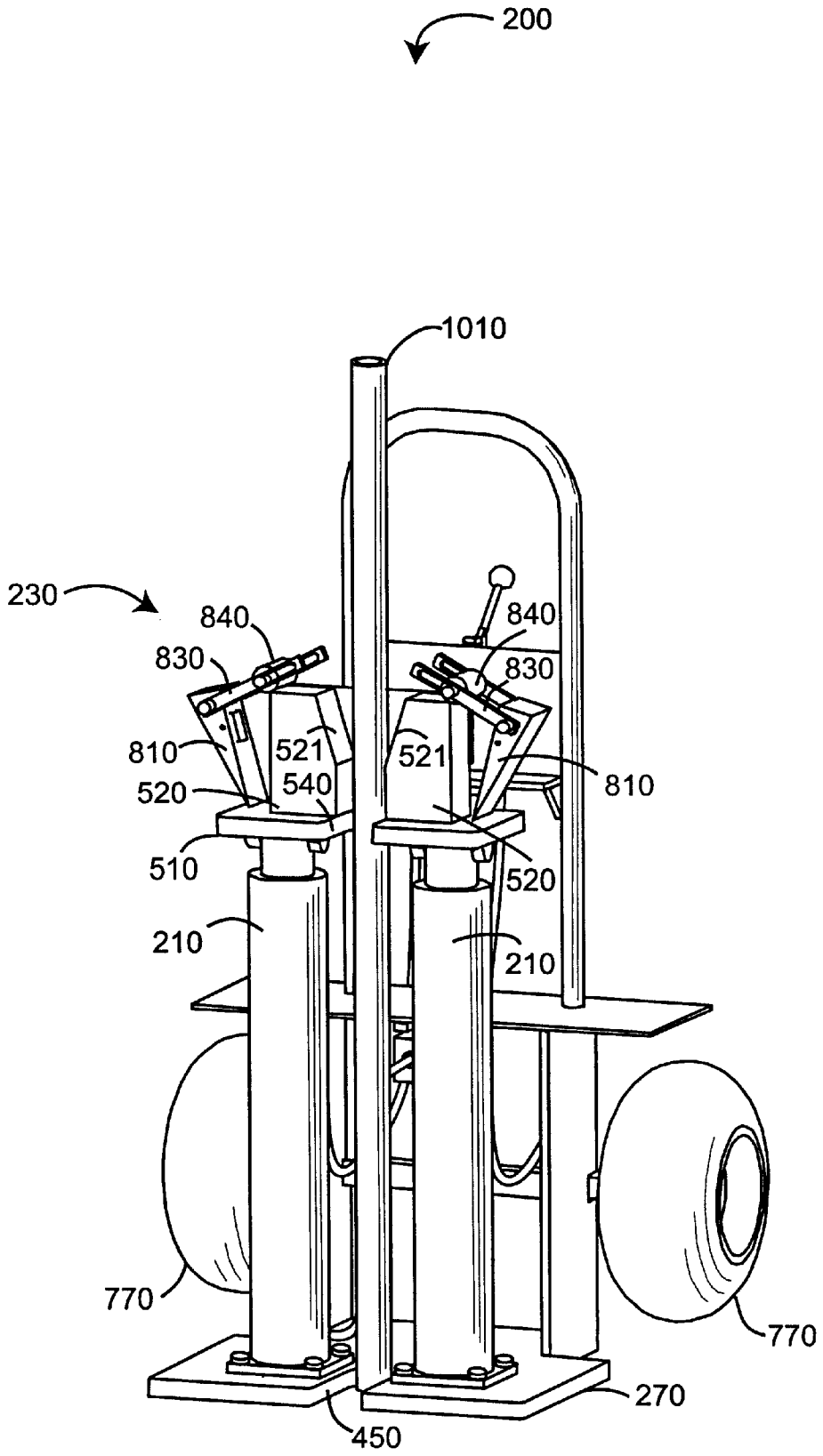
FIG. 10A is a perspective view of an extraction tool with the gripping assembly in an open position and the tool positioned on an installed injection casing.
Figure 10B:
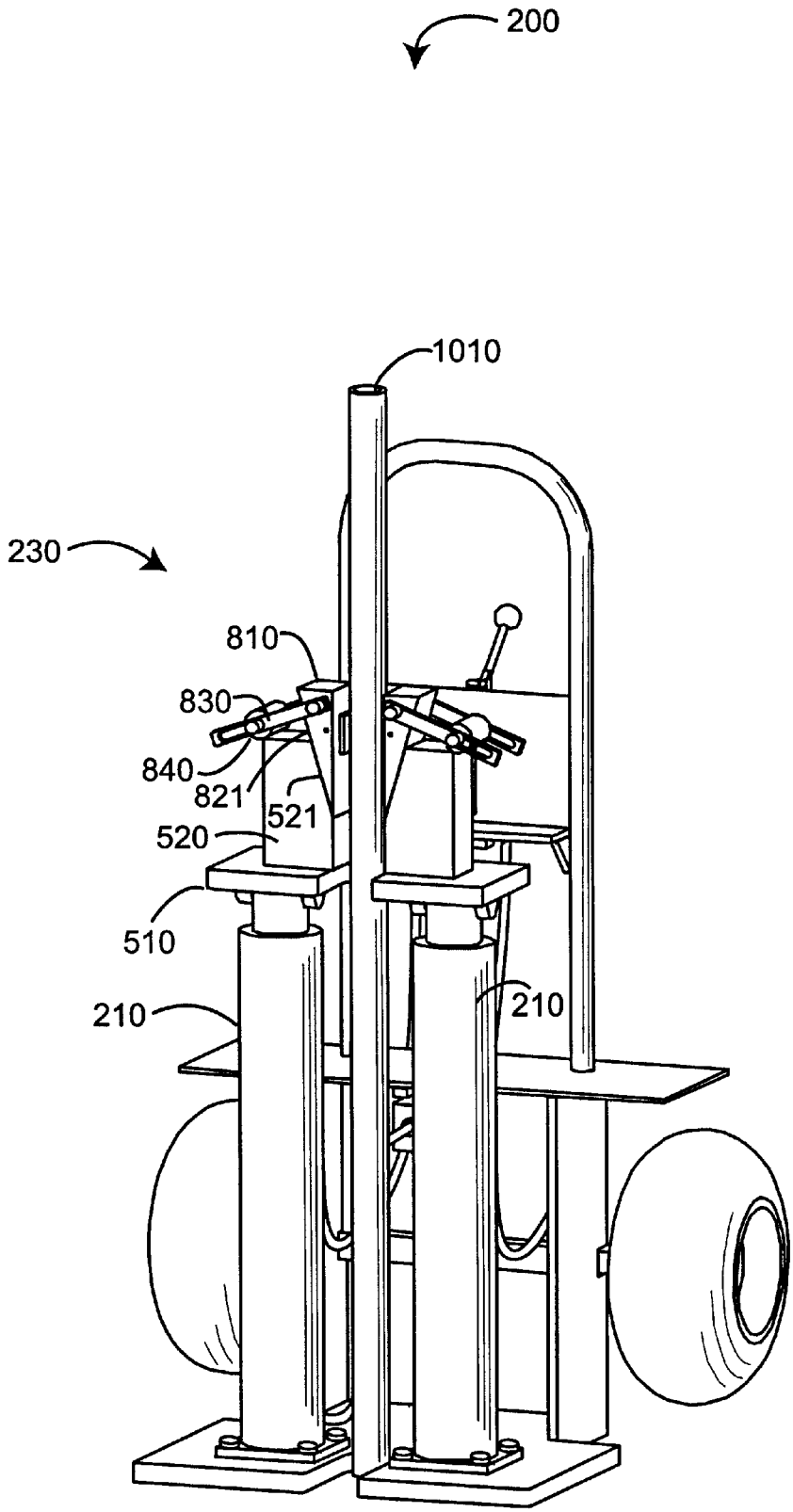
FIG. 10B is a perspective view of an extraction tool with the gripping assembly closed on an installed injection casing and the cylinders in a retracted position.
Figure 10C:
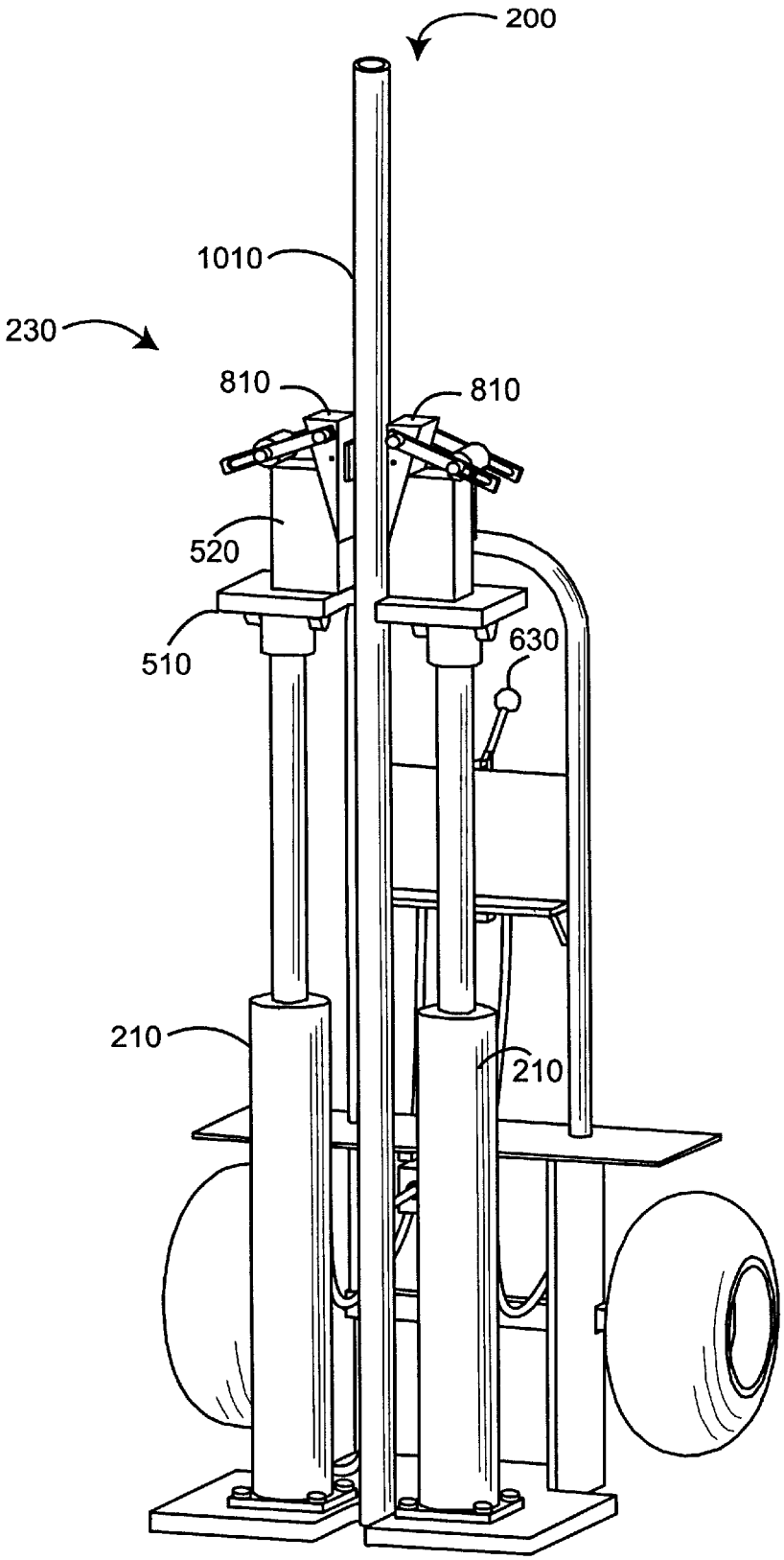
FIG. 10C is a perspective view of an extraction tool with the cylinders in an extended position after extracting a portion of injection casing.
Figure 10D:
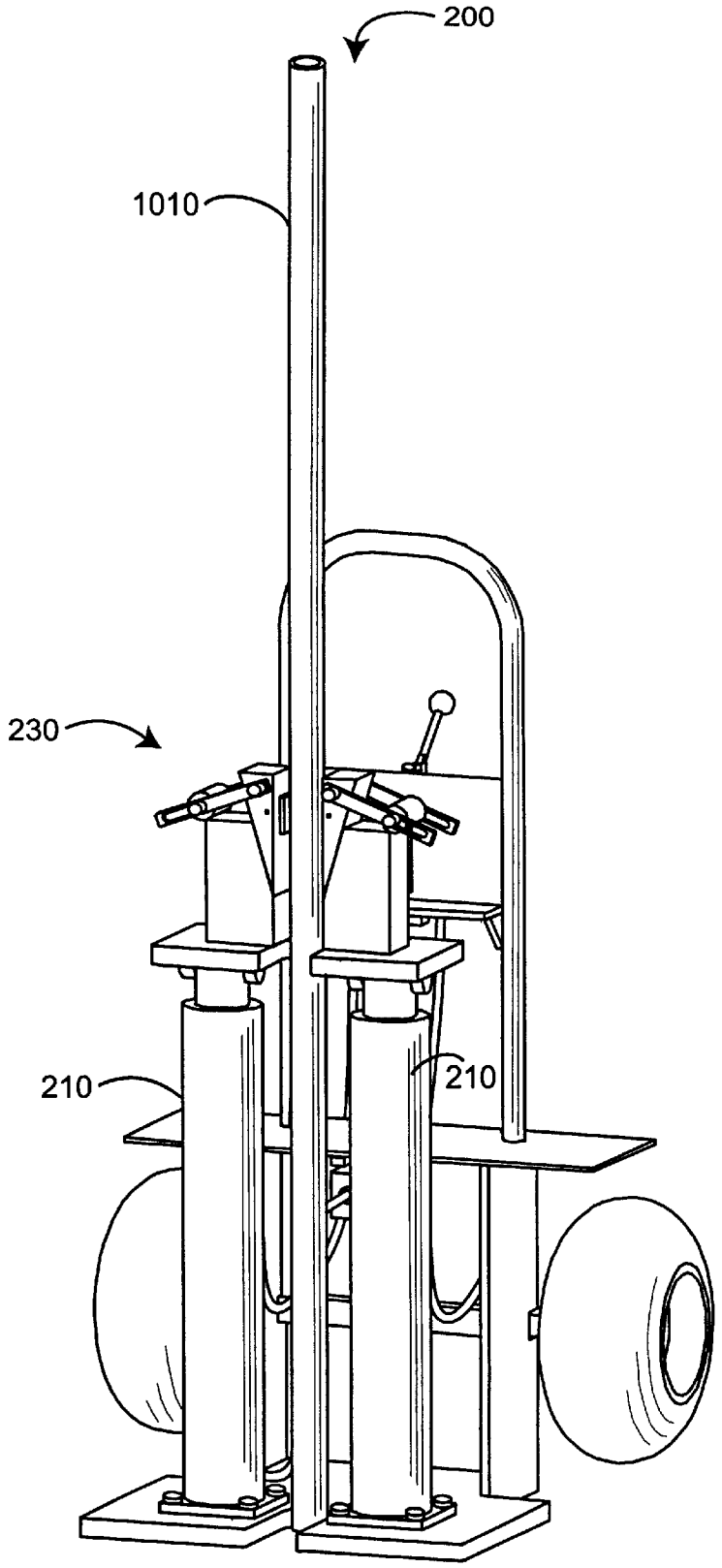
FIG. 10D is a perspective view of an extraction tool with the cylinders in a retracted position after extracting a portion of injection casing.

A pair of wedges 810 (FIG. 8) forms a gripping assembly 230 that together with the chuck block assembly 220 (FIG. 5) provides a progressive chuck mechanism that secures an injection casing 1010 (FIG. 10B) between a pair of teeth 860 on an upward movement or extension of the cylinders 210 (FIG. 10B) and that releases the injection casing 1010 (FIG. 10D) on a downward movement or retraction of the cylinders 210 (FIG. 10D). The retainers 830 retain the wedges 810 outside the chuck block assembly 220 (FIG. 2A) when disconnecting or connecting sections of injection casing. In one embodiment, a U-shaped piece of ⅝" steel rebar can be welded to the top face 822 of each wedge 810 to function as a handles for moving the wedges 810 either outside or inside the chuck block assembly 220.

FIG. 9 illustrates the teeth 860, which is one of a pair of identical gripping elements for the gripping assembly 230. The teeth 860 have a 1-¾" length 934, ⅝" depth 936, and 1-¼" width 938. The teeth 860 have a toothed face 920 containing multiple tooth rows 960, a base 930, a tongue 940 and a retaining hole 910. The tongue 940 is set into a slot in the perpendicular wedge face 823 (FIG. 8). Further, a portion of the perpendicular wedge face 823 (FIG. 8) is recessed and accommodates an ⅛" portion 932 of the base 930. In this manner, the teeth 860 are retained by the wedge 810 (FIG. 8) and secured by a pin through the retaining hole 910, as described above with respect to FIG. 8. The teeth 860 are available as a Ridgid Tool brand Heel Jaw & Pin, item number 182-6528, from Grainger Parts Operation, Northbrook, Ill. The above item is modified by cutting an additional tooth row 950 at one end of the toothed face 920. This modification provides an additional gripping surface on the toothed face 920.

One of ordinary skill will appreciate that other gripping elements can be mounted on the perpendicular wedge face 823 (FIG. 8) in lieu of the teeth 860 illustrated in FIG. 9. Multiple gripping elements can be mounted on each wedge face. For example, each wedge face could have one or more wedge-shaped or contoured teeth with tooth rows that mate with the curvature of a casing wall. Alternately, each wedge face could have one or more rough-surfaced elements that provide sufficient friction to grip a casing.

FIGS. 10A–D illustrate the operation of the extraction tool 200. FIG. 10A illustrates the extraction tool 200 positioned on an injection casing 1010 with the gripping assembly 230 in an open position. The extraction tool 200 is in its operating position with the steel plate 270 positioned against the ground and the tires 770 offset from the ground. The gripping assembly 230 is initially placed in an open position with the wedge retainers 830 rotated around the hinges 840 so that the wedges 810 are positioned away from the angled faces 521 of the chuck blocks 520. The extraction tool 200 is then positioned on an installed injection casing 1010 by sliding the casing 1010 into the open-face slots 450, 540 of the chassis and chuck base plates 270, 510. In this manner, the casing 1010 runs parallel between the cylinders 210 and within the interior space between the chuck blocks 520.

FIG. 10B illustrates the extraction tool gripping assembly 230 in a closed position just prior to initiating extraction of the injection casing 1010. The wedge retainers 830 are rotated around the hinges 840 so that the wedges 810 are positioned within the interior space formed by the chuck blocks 520. In this closed position, each wedge face 821 and a corresponding chuck block face 521 are in mutual contact and the wedge teeth 860 (FIG. 8) of each wedge 810 are positioned generally flush against opposite surfaces of the wall of the casing 1010. As the cylinders 210 push upward on the chuck base plate 510 at the beginning of an extension portion of the extraction cycle, the chuck blocks 520 are forced upward relative to the wedges 810. This relative movement also creates a movement of the wedges 810 toward each other, resulting in a tight grip position with increasing sideways pressure of the teeth 860 (FIG. 8) against the casing 1010. The relative movement of the wedges 810 continues until there is sufficient gripping force on the casing 1010 so that the extension of the cylinders 210 is translated into an extraction movement of the casing 1010 from the soil. The relative movement of the wedges 810 and resulting sideways pressure of the teeth 860 (FIG. 8) is advantageously self-limiting, increasing only to the point at which the casing 1010 begins to move from the ground, which avoids crushing the casing 1010. Advantageously, the wedge teeth 860 (FIG. 8) have multiple tooth rows 960 (FIG. 9) that remain generally flush against the casing 1010, distributing the pressure from the teeth 860 across an area of the casing wall rather than at a few points. These damage prevention features allow reuse of extracted casings.

FIG. 10C illustrates the extraction tool 200 just after the cylinder extension portion of an extraction cycle has been completed. In this position, the operator reverses the control valve 630, causing the cylinders 210 to begin retracting. This reverses the process described with respect to FIG. 10B. As the cylinders 210 withdraw at the beginning of the retraction portion of the extraction cycle, a downward force is applied to the chuck base plate 510, the chuck blocks 520 move downward relative to the wedges 810. This relative movement causes a movement of the wedges 810 away from each other to a loose grip position and decreasing sideways pressure of the teeth 860 (FIG. 8) against the casing 1010. The relative movement continues until the gripping force on the casing 1010 is released and the gripping assembly 230 releases the casing 1010 as the cylinders 210 move to their retracted position.

FIG. 10D illustrates the extraction tool 200 just after the cylinder retraction portion of an extraction cycle. The gripping assembly 230 is loose around the casing 1010 and the cylinders 210 are in a position to begin extension under pressure, beginning another extraction cycle, as shown in FIG. 10B. In this manner, the chuck block assembly 220 (FIG. 2A) and gripping assembly 230 provide a progressive chuck mechanism that alternately grips and releases a casing on each extension/retraction cycle of the cylinders 210. The extraction tool 200 utilizes this progressive chucking effect to jack a casing from the ground in multiple stages.

The extraction tool 200 (FIGS. 10A–D) has been disclosed with respect to a compaction grouting application, where injection casings are pulled from the ground in stages. One of ordinary skill, however, will recognize the extraction tool's applicability to any application involving the extraction of casings, poles, pipes, rods, cables or other elongated articles (generally "shafts") from a surrounding media, such as soil, stone, bricks, concrete, mortar or sand forming the ground, floors, walls, foundations or similar structures. The dimensions of the embodiments disclosed herein can be readily scaled to accommodate and extract shafts of smaller or larger dimensions than 1½" schedule 80 casings, such as 2" schedule 80 casings, sign poles, fence posts, utility poles, and oil-well casings to name a few.

A typical extraction application utilizes the extraction tool positioned on the ground, pulling a shaft vertically. One of ordinary skill will recognize that the extraction tool can be positioned against any external support structure or media and utilized to extract a shaft in any direction. For example, the chassis base plate could be positioned against a vertical wall to horizontally extract an embedded rod from the wall. Further, the extraction tool can be used for applications other than extraction, such as testing shaft strength or the holding strength of the surrounding media. For example, the extraction tool combined with a strain gauge could test the strength of a retaining wall tieback. Another non-extraction use of the extraction tool is to pre-stress a cable or pull one cable end so as to exert a force on a load at the other cable end.

The portable injection-casing extractor has been disclosed in detail in connection with various embodiments of the present invention. These embodiments are disclosed by way of examples only and are not to limit the scope of the present invention, which is defined by the claims that follow. One of ordinary skill in the art will appreciate many variations and modifications within the scope of this invention.

What is claimed is:

1. An extraction tool for progressively jacking a shaft from its surrounding media comprising:

a lift having a stationary end and a moveable end;

a block assembly attached to said moveable end, said block assembly defining an interior space configured to accommodate said shaft; and a plurality of opposing grips configured to have an open position and a closed position disposed around said shaft within said interior space, each of said grips distal the other of said grips in said open position and proximate the other of said grips in said closed position, said grips, while in said closed position, configured to have a loose grip position and a tight grip position on said shaft wherein, as said moveable end extends from said stationary end, said grips move to said tight grip position and, as said moveable end retracts toward said stationary end, said grips move to said loose grip position, so that said grips remain in said closed position as said lift extends and retracts, alternately securing said shaft to said block assembly and releasing said shaft from said block assembly, respectively.

2. The extraction tool of claim 1 wherein at least one of said grips has a plurality of tooth rows configured so that said tooth rows are in flush contact with said shaft in both said loose grip position and said tight grip position.

3. The extraction tool of claim 1 wherein said block assembly comprises a plurality of chuck blocks and said grips comprise a corresponding plurality of wedges, said chuck blocks each having a block angled face proximate said interior space, said wedges each having a wedge angled face and an opposite perpendicular face, said wedges each further having a wide end and an opposite narrow end between said wedge angled face and said perpendicular face, said wedge angled face being in slidable contact with a corresponding said block angled face so that as said moveable end extends from said stationary end, each of said blocks move relatively toward said wide end of each of said wedges, transitioning said wedges from said loose grip position to said tight grip position.

4. The extraction tool of claim 3 wherein said wedge angled face and said wedge perpendicular face form an angle in the range of 12 to 20 degrees.

5. The extraction tool of claim 1 further comprising:

a hinge attached to said block assembly;

a retainer rotatably mounted to said hinge, said grips rotatably mounted to said retainer so that said grips are retained by said block assembly; and a handle attached to said grips so that said grips are manually moveable between said open position and said closed position.

6. A method of extracting an installed shaft from a surrounding media, said shaft having a protruding end extending from said media, said method comprising the steps of:

positioning a lift proximate said shaft protruding end, said lift having a moveable end and a stationary end, said media supporting said stationary end and said moveable end supporting a chuck;

loading a first portion of said shaft protruding end into said chuck;

positioning a grip portion of said chuck proximate said shaft portion;

contacting said shaft portion flush with a surface of a gripping element mounted on said grip portion;

initiating extension of said lift moveable end away from said lift stationary end;

securing said shaft portion with said grip portion in response to said initiating extension step;

completing extension of said lift moveable end with said shaft portion secured to said chuck so as to at least partially remove said shaft from said media;

initiating retraction of said lift moveable end toward said lift stationary end;

releasing said shaft portion with said grip portion in response to said initiating retraction step, completing retraction of said lift moveable end toward said lift stationary end with said shaft portion released from said chuck so as to load a second portion of said shaft protruding end into said chuck, said second portion located between said first portion and said media.

7. The method of claim 6 wherein said securing step comprises the substeps of:

increasing the pressure exerted by said grip portion on said shaft portion as said lift moveable end extends away from said lift stationary end; and limiting the pressure exerted by said grip portion on said shaft portion at the point said shaft begins to move from said media.

8. The method of claim 6 wherein said releasing step comprises the substep of moving said grip portion from a tight grip position to a loose grip position while maintaining said grip portion proximate said shaft portion.

9. An extraction tool having an operating position and a transport position, said tool comprising:

a generally planar base plate having a first face, an opposite second face and a back edge between said first and second faces, said first face contacting the ground and said second face distal the ground in said operating position;

a frame attached to said back edge and extending generally perpendicularly away from said second face;

at least one of a plurality of tires mounted on each side of said frame, said tires offset from the ground in said operating position, said tires and said back edge contacting the ground in said transport position, said tool being stable and self-standing in both said operating position and in said transport position; and a chuck moveably mounted to said plate.

10. The extraction tool of claim 9 further comprising a handle attached to said frame and extending generally perpendicularly away from said second face so as to provide leverage for moving said tool from said operating position to said transport position.

11. The extraction tool of claim 10 further comprising a plurality of integrated steps, at least one of said steps located on each of said frame and said handle, said base plate having a sufficient weight and footprint so as to provide stable support for a person standing on any of said steps without externally supporting said tool.

12. The extraction tool of claim 9 wherein the weight of said base plate is at least about 90 pounds and the footprint of said base plate is at least about 470 square inches.

13. The extraction tool of claim 9 wherein each of said base plate and said chuck have an open-face slot configured to accommodate shafts.

14. An extraction tool comprising:

a base means for supporting said tool;

an open-face plate means for loading and retaining shafts;

a lift means mounted to said base means and said open-face plate means for moving said open-face plate means from a first position proximate said base means to a second position distal said base means; and a progressive chuck means mounted to said open-face plate means for securing shafts as said open-face plate means moves from said first position to said second position and for releasing shafts as said open-face plate means moves from said second position to said first position.

15. The extraction tool of claim 14 further comprising a plurality of step means for supporting a person climbing to a position above said tool to set-up and operate said tool.

16. The extraction tool of claim 14 wherein said base means further comprises an open-face base means for loading and retaining shafts.

17. The extraction tool of claim 14 further comprising a transport means for moving said tool.

18. The extraction tool of claim 14 further comprising a handle means for positioning said tool.

* * * * *